US005683058A

United States Patent [19]

Schwarz et al.

[11] Patent Number: 5,683,058

[45] Date of Patent: Nov. 4, 1997

[54] ROLL SUPPORTING HUB

[75] Inventors: Edward J. Schwarz; Michael J. Cavanagh, both of Woodbury; Craig D. Thompson, Inver Grove Heights; Lloyd S. Vasilakes; Van E. Jensen, both of Stillwater, all of Minn.

[73] Assignee: Minnesota Mining and Manufacturing Company, St. Paul, Minn.

[21] Appl. No.: 629,710

[22] Filed: Apr. 9, 1996

Related U.S. Application Data

[63] Continuation of Ser. No. 611,320, Mar. 5, 1996, abandoned.

[51] Int. Cl.[6] ..... B65H 75/24

[52] U.S. Cl. ..... 242/578.2; 242/597.3

[58] Field of Search ..... 242/578, 578.2, 242/578.3, 597.3, 608, 608.2, 608.3, 608.4, 608.7, 609, 609.2, 613, 613.4, 614, 614.1

[56] References Cited

U.S. PATENT DOCUMENTS

| | | | |
|---|---|---|---|
| 1,234,746 | 7/1917 | Fish . | |
| 2,171,648 | 9/1939 | Ennis et al. | 242/597.3 |
| 2,983,531 | 5/1961 | Moro | 242/597.3 |
| 3,017,133 | 1/1962 | Bowler . | |
| 3,315,728 | 4/1967 | Anderson et al. | 160/326 |
| 3,347,485 | 10/1967 | Bundschuh | 242/597.3 |
| 3,359,020 | 12/1967 | O'Donnell | 242/597.3 |
| 3,417,939 | 12/1968 | Bunting | 242/597.3 |
| 3,482,794 | 12/1969 | Beardsley | 242/597.3 |
| 3,706,488 | 12/1972 | Masetta | 353/26 |
| 3,840,193 | 10/1974 | Feichtiner et al. | 242/597.3 |
| 3,944,153 | 3/1976 | Linker | 242/597.3 |
| 4,109,878 | 8/1978 | Osawa . | |
| 4,158,205 | 6/1979 | Jenkins, Jr. | 346/136 |
| 4,570,869 | 2/1986 | Tsuji . | |
| 4,854,518 | 8/1989 | Yamazaki et al. . | |
| 5,351,901 | 10/1994 | Scholtysik et al. | 242/540 |
| 5,370,339 | 12/1994 | Moody et al. | 242/597.3 |
| 5,375,791 | 12/1994 | Kline et al. | 242/575 |

FOREIGN PATENT DOCUMENTS 27 54 291 6/1978 Germany .

OTHER PUBLICATIONS

3M Masking and Packaging Systems Division, Specifications and Parts List, "Scotch™ Friction Brake Tape Drums," form 34–7004–7131–0(G72.15)R2 CFD 381A, 1992.

3M Masking and Packaging Systems Division, brochures "3M–Matic™ Case Sealers from 3M–Designed to meet a wide range of case sealing needs," form 70–0705–0840–6 (245)BE, 1994.

IBM Technical Disclosure Bulletin, "Tape Reel Holder," vol. 13, No. 8 (Jan., 1971).

*Primary Examiner*—John P. Darling

*Attorney, Agent, or Firm*—Gary L. Griswold; Walter N. Kirn; Charles D. Levine

[57] ABSTRACT

A roll supporting hub is adapted for acceptance of a plurality of rolls (one at a time), with each roll having a different predefined core width. The hub includes a hub body with a plurality of core support surfaces spaced circumferentially about a central rotation axis. One or more of those surfaces engage the core of the roll to secure the roll and hub together for coupled rotation. A stop surface on the hub body engages a first radial side of the core, while a radially retractable retainer surface engages a second radial side of the core. The retainer surface is secured to the hub body in one of a plurality of possible predefined axially disposed positions relative to the stop surface, each of which corresponds to one of the predetermined core widths of the roll being supported by the hub. The retainer surface is supported by a spring which is retractable within a slot extending axially between opposed support surfaces on the hub body.

14 Claims, 6 Drawing Sheets

ROLL SUPPORTING HUB

This application is a continuation of U.S. patent application Ser. No. 08/611,320, filed Mar. 5, 1996, now abandoned.

BACKGROUND OF THE INVENTION

The present invention relates, in general, to apparatus for supporting a roll of material for the winding or unwinding thereof. Specifically, the present invention relates to a single hub which is adaptable for supporting, one at a time, a plurality of rolls of differing widths.

Strip materials (such as pressure sensitive adhesive tape) are often supplied in roll form, wound about a cylindrical core of stiffened cardboard, plastic or other suitable core material. In a typical application, box sealing tape is wound on a three-inch diameter core, and the final diameter of a roll of box sealing tape formed in this manner may be as large as 18 inches, or even larger. Such rolls of box sealing tape are then mounted on box sealing machines which can seal the sides and ends of a corrugated box as it traverses the machine. Machines of this type are known as 3M-Matic Case Sealers, available from Minnesota Mining and Manufacturing Company, St. Paul, Minn.

In such a box sealing machine, a roll of tape is supported on a tape drum or hub which engages the inner diameter of the roll so that the roll rotates in coupled rotation with the tape drum. Prior art tape drums have affirmatively engaged the core of a tape roll for coupled rotation by means of a friction interference fit, or by providing a cam operable on the tape drum for an interference fit with the core once the cam is actuated. Tape drums of this type are available from Minnesota Mining and Manufacturing Company, St. Paul, Minn., referenced as Scotch™ Tape Drum, Part No. 78-8023-2617-9 and Part No. 70-8000-3142-2, respectively.

In box sealing tape machines, the tape roll is subjected to starts, stops and constant changes in acceleration as it dispenses tape for sealing boxes traversing the machine. Over time, a friction interference fit can become loosened because of this type of motion and, as a result, the tape roll can move axially, causing tape misalignment, or ultimately allowing the tape roll to fall off of the hub. Likewise, a cam can become dislodged inadvertently or loosened because of the constantly changing motion of the tape roll, with the same undesirable consequences.

SUMMARY OF THE INVENTION

The present invention is a hub for supporting a roll of material having a central core with first and second sides and having a plurality of possible predefined widths. The hub has a hub body having a core support surface extending circumferentially about a central rotation axis. The hub includes means for securing the central core of the roll to the support surface for coupled coaxial rotation of the roll and hub body. A stop surface on the hub body engages the first radial side of the core of the roll. A radially retractable retainer surface engages the second radial side of the core. The retainer surface is selectively secured to the hub body and is spaced axially from the stop surface. The retainer surface has a plurality of possible predefined axially disposed positions relative to the stop surface, each of which corresponds to one of the predetermined widths of the roll being supported by the hub.

In a preferred embodiment, the core support surface is defined by a plurality of such surfaces spaced circumferentially about the central axis. Preferably, the hub body has at least one axially extending surface slot spaced circumferentially about the central axis, with the slot including means to receive the retainer surface therein for placing the retainer surface in at least one of its predefined positions. At least two of the possible predefined positions for the retainer surface are preferably defined in the slot. In a preferred embodiment, the hub further includes an arm having first and second ends adapted to be selectively received within each slot, with the arm bearing the retainer surface adjacent its first end and being secured to the hub body adjacent its second end. The retainer surface is movable between two positions, an operation position and a core insertion position, with retainer surface in its operation position when engaging the second radial side of the core. The arm supporting the retainer surface is mounted relative to the hub body to permit radial retraction of the retainer surface within the slot to its core insertion position. The arm has a stop for engaging a portion of the hub body to limit movement of the retainer surface radially outwardly past its operation position.

In another defined embodiment of the present invention, the inventive hub of the present invention is designed for supporting a tape roll having a central core with first and second radial sides. The hub has a core support surface extending circumferentially about a central axis, with at least a portion thereof frictionally connecting the core to the hub for coupled rotation therewith. The hub has a stop surface for engaging the first radial side of the core, and a retainer surface spaced axially from the stop surface. A bias member supports the retainer surface relative to the core support surface. The bias member is movable between a first extended position whereby the retainer surface is positioned to engage the second radial side of the core to prevent removal of the core off the hub, and a second retracted position to permit axial movement of the core past the retainer surface on the bias member.

BRIEF DESCRIPTION OF THE DRAWINGS

The present invention will be further explained with reference to the drawing figures listed below wherein like structure is referred to by like numerals throughout the several views.

While the above-identified drawing features set forth one preferred embodiment, other embodiments of the present invention are also contemplated, as noted in the discussion. This disclosure presents an illustrative embodiment of the present invention by way of representation and not limitation. Numerous other modifications and embodiments can be devised by those skilled in the art which fall within the scope and spirit of the principles of this invention.

DETAILED DESCRIPTION OF THE PREFERRED EMBODIMENTS

Figure 1:
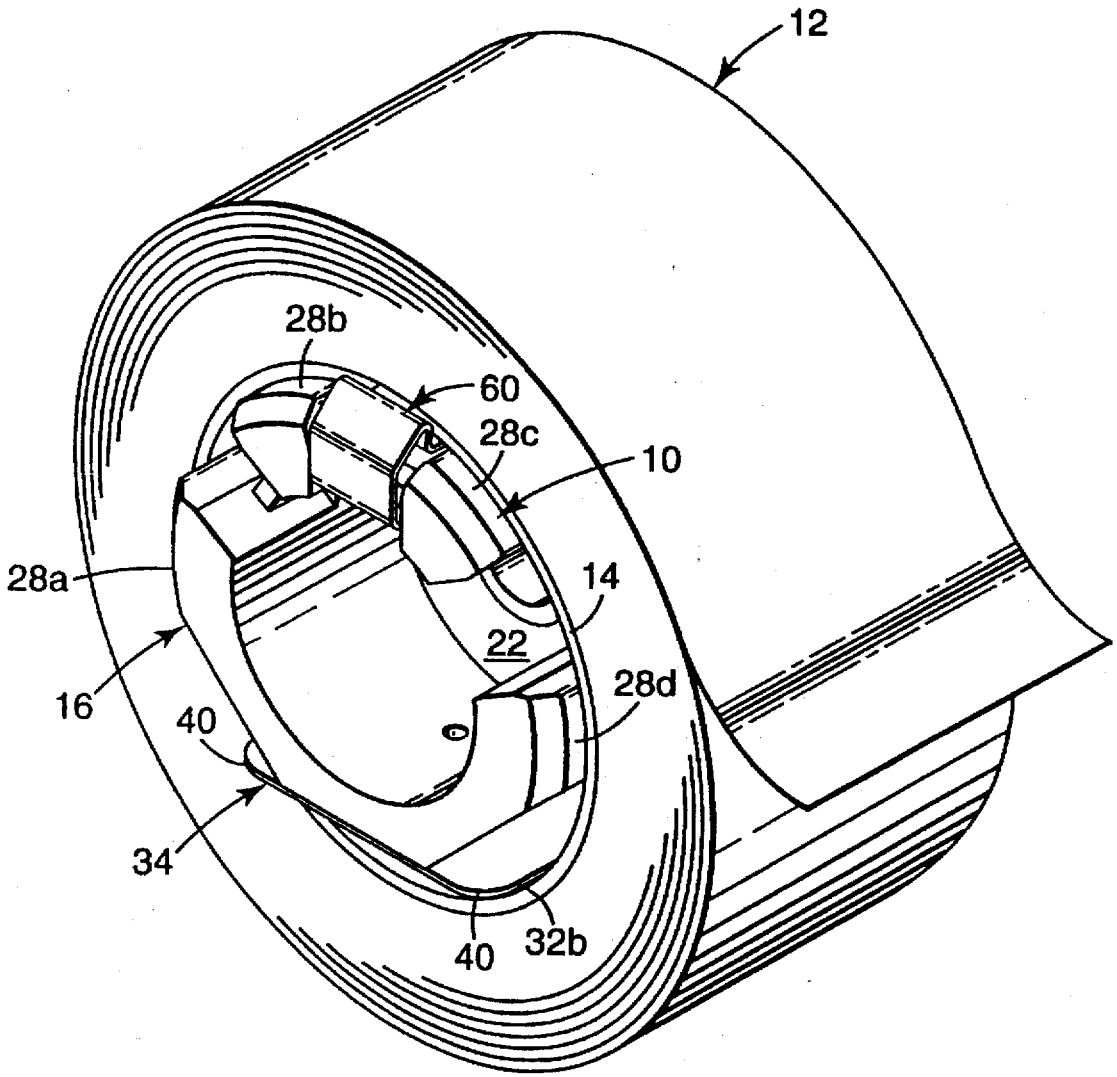
FIG. 1 is an isometric view of the inventive tape hub of the present invention, bearing a roll of tape thereon.
Figure 2:
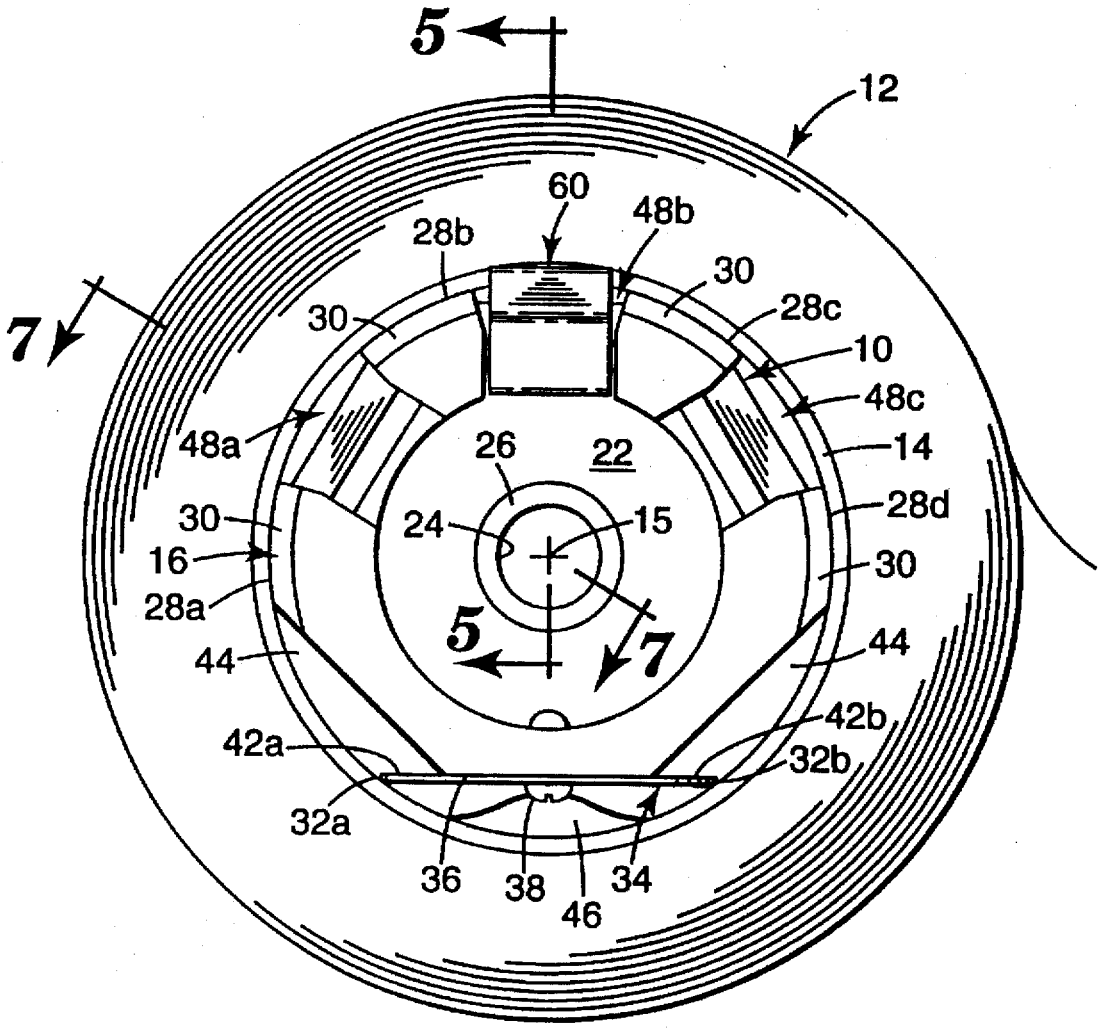
FIG. 2 is a front elevational view of the inventive hub with a tape roll thereon.
Figure 3:
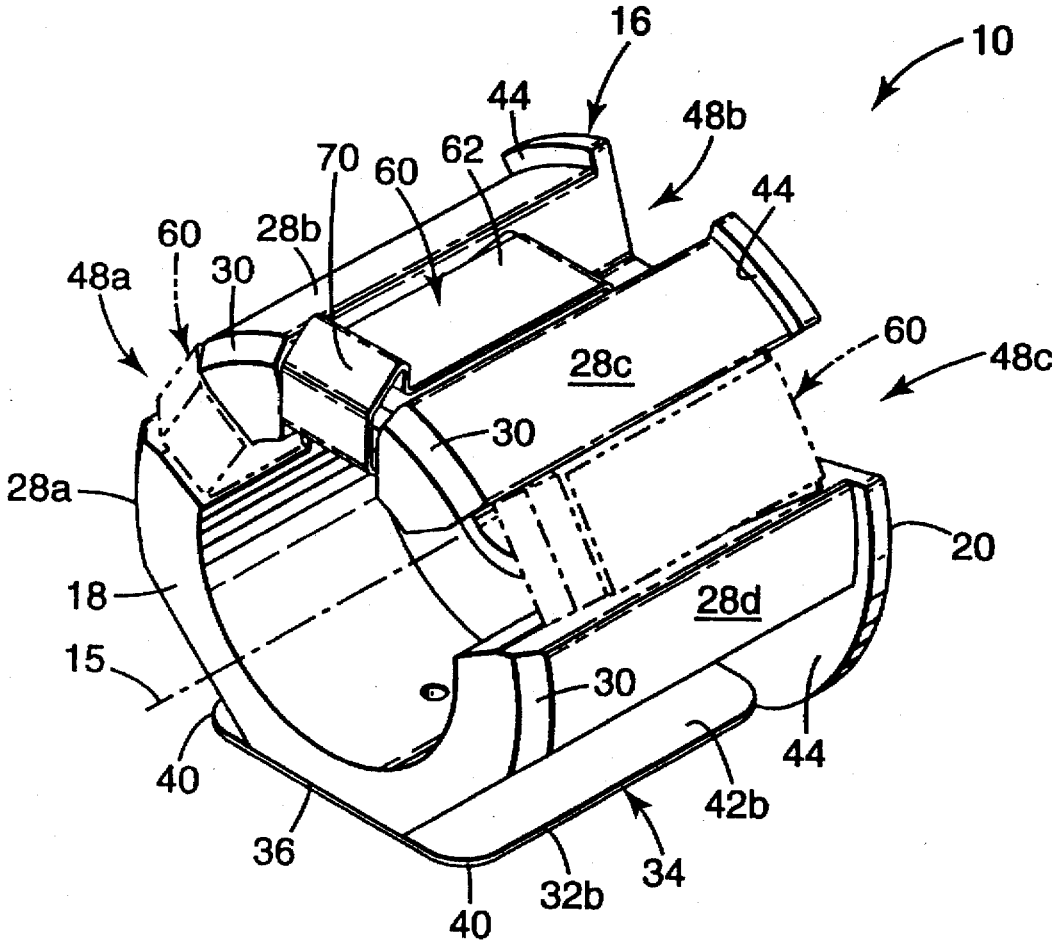
FIG. 3 is an isometric view of the inventive hub with the tape roll removed.

FIGS. 1 and 2 illustrate the roll supporting hub or drum 10 of the present invention, bearing a roll 12 thereon. The roll 12 may be formed from a wound strip of any material, such as paper, cloth or plastic film, and may be provided with adhesive on one or both sides thereof. In one application of the invention, the roll 12 is formed from box sealing tape with adhesive on one side thereof. The roll 12 is wound about a core 14, which may be formed from cardboard, plastic or other suitable material. In the case of box sealing tape, the core has typically been a three-inch diameter core, although alternative core diameters are contemplated. It is understood that a roll of material may be wound without a separately defined "core," and such rolls are intended to be encompassed within the definition of the use of the term "roll" herein. Although no separate "core" is present in such "coreless" rolls, a portion of the wound material adjacent the winding axis effectively serves as the "core" therefor.

The hub 10 is formed about a central axis 15, and includes a hub body 16 which is axially elongated, having a first end 18 and second end 20. The hub body 16 has a central portion 22 with an axially aligned bore 24 therethrough. The hub 10 is mounted by a suitable fastener (not shown) extending through the bore 24 to a machine or device for dispensing the strip material (e.g., tape) from the roll 12. In one preferred embodiment, the hub body 16 is formed from 17% glassed filled ABS molded about a sintered bronze bore liner 26 (as shown), with the interior of the liner forming the bore 24. Alternatively, the hub body 16 may be molded from acetal plastic material, whereby no discrete bore liner may be necessary.

The hub body 16 has a core support surface extending about the central axis 15, which is defined by a plurality of axially extending core support surfaces 28*a*, 28*b*, 28*c*, and 28*d* that are spaced apart circumferentially about the central axis 15. Each core support surface has a beveled surface 30 adjacent the first end 18 of the hub body 16 to facilitate insertion of a roll 12 onto the hub 10. Preferably, the bevel is about 45 relative to the central axis 15.

The core support surfaces are not positioned as circumferential segments spaced entirely about the central axis 15. The core support surfaces instead include edge surfaces 32*a* and 32*b*. Each edge surface extends axially along the hub body 16, parallel to the central axis 15, and is generally opposed 180° from a circumferential core support surface (i.e., edge surface 32*a* is opposed from support surface 28*c* and edge surface 32*b* is opposed from support surface 28*b*). The edge surfaces 32*a* and 32*b* are defined by axially extending edges of a flexible sheet 34. The sheet 34 is secured to the hub body 16 along an axially extending planer face 36 thereof, by one or more suitable fasteners 38. Corners 40 of the sheet 34 are rounded adjacent the first end 18 of the hub body 16 to facilitate insertion of the roll 12 onto the hub 10.

The sheet 34 is affixed so that marginal portions 42*a* and 42*b* thereof extend beyond the face 36 of the hub body 16 and terminate in the edge surfaces 32*a* and 32*b*, respectively. The edge surfaces 32*a* and 32*b* extend slightly farther from the central axis 15 than the defined inner diameter of the core 14. The sheet 34 is flexible so that upon insertion of a core 14 onto the hub 10, the marginal portions 42*a* and 42*b* flex and affirmatively bias the edge surfaces 32*a* and 32*b* against the inner diameter of the core 14. This effectively and frictionally secures the core 14 to the hub 10 for coupled rotation therewith. The edge surfaces 32*a* and 32*b* are opposed (on the chord defined by the sheet 34, as shown) to secure the core 14 to the hub 10 whether relative rotation therebetween is clockwise or counterclockwise. The edge surfaces 32*a* and 32*b* preferably extend at least a significant portion, if not entirely, along the width of the core 14. Likewise, the core support surfaces 28*a*, 28*b*, 28*c* and 28*d* preferably extend at least a significant portion, if not entirely, along the width of a core 14 placed on the hub 10.

The hub body 16 has a rear radial stop surface adjacent its second end 20 for limiting the extent of axial insertion of the roll 12 thereon. The radial stop surface is defined by one or more radially extending surfaces 44 (see FIGS. 3–6). Preferably, a segment of radially extending surface 44 projects adjacent each core support surface 28*a*, 28*b*, 28*c* and 28*d*. That portion of the radially extending surface 44 adjacent core support surfaces 28*a* and 28*d* continues circumferentially about the second end 20 of the hub body 10 beyond those engaging surfaces, except for a cutaway section 46 disposed between the edge surfaces 32*a* and 32*b*. The cutaway section 46 facilitates manual removal of an empty core 14 from the hub 10. One side of a core 14 inserted onto the hub 10 thus abuts the radially extending surfaces 44 when fully inserted.

Figure 5:
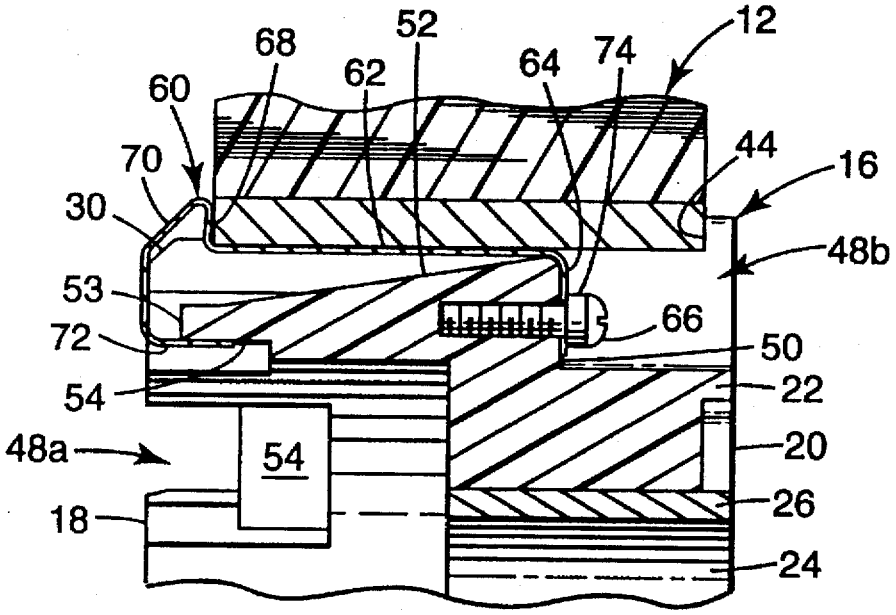
FIG. 5 is a partial sectional view of the inventive hub as taken along lines 5—5 in FIG. 2, showing the arm supporting the retainer surface in a first predefined position within slot **48*b*** of the hub body.
Figure 6:
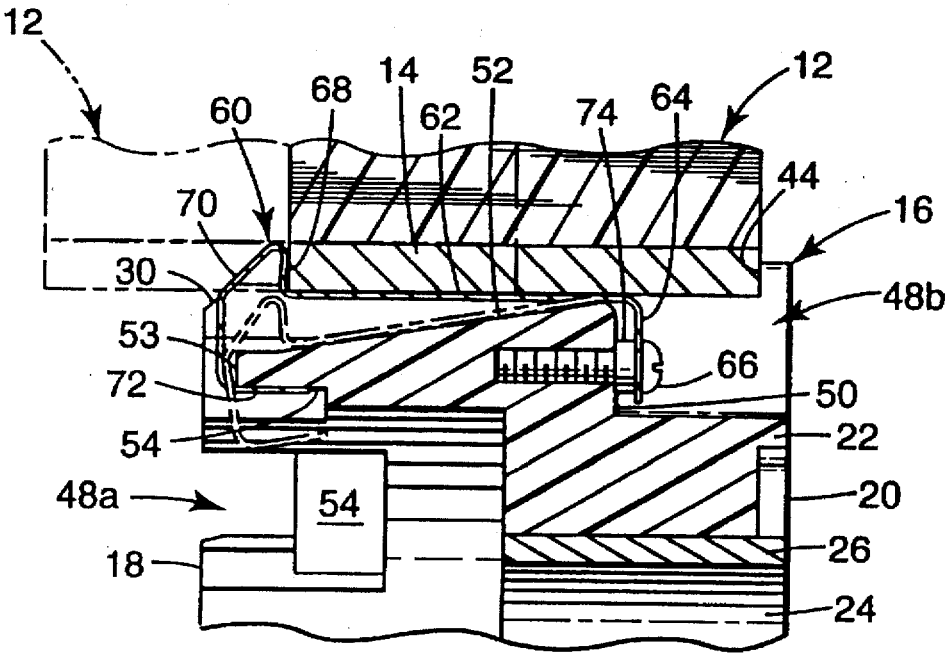
FIG. 6 is a partial sectional view of the inventive hub as taken along lines 5—5 in FIG. 2, showing the arm supporting the retainer surface in a second predefined position within slot **48*b*** of the hub body.

The hub body 16 has longitudinally disposed slots between selective core engaging surfaces. As shown, the hub body 16 has an axially extending slot 48*a* between core support surfaces 28*a* and 28*b*, a slot 48*b* similarly disposed between core support surfaces 28*b* and 28*c*, and a slot 48*c* similarly disposed between core support surfaces 28*c* and 28*d*. The configurations of each slot are generally similar, although some surfaces in the slots differ in axial orientation. Each slot is defined by portions of the hub body 16, and as best shown in FIGS. 5 and 6, each slot includes a radial mounting face 50 adjacent the second end 20 of the hub body 16. The slot has a ramped release face 52 extending toward the first end 18 of the hub body 16 from the radial mounting face 50 (the ramped release face becomes closer to the central axis 15 as it extends toward the first end 18). Adjacent the first end 18 of the hub body 16, each slot includes an end protrusion 53 having an inner radial stop face 54.

Figure 4:
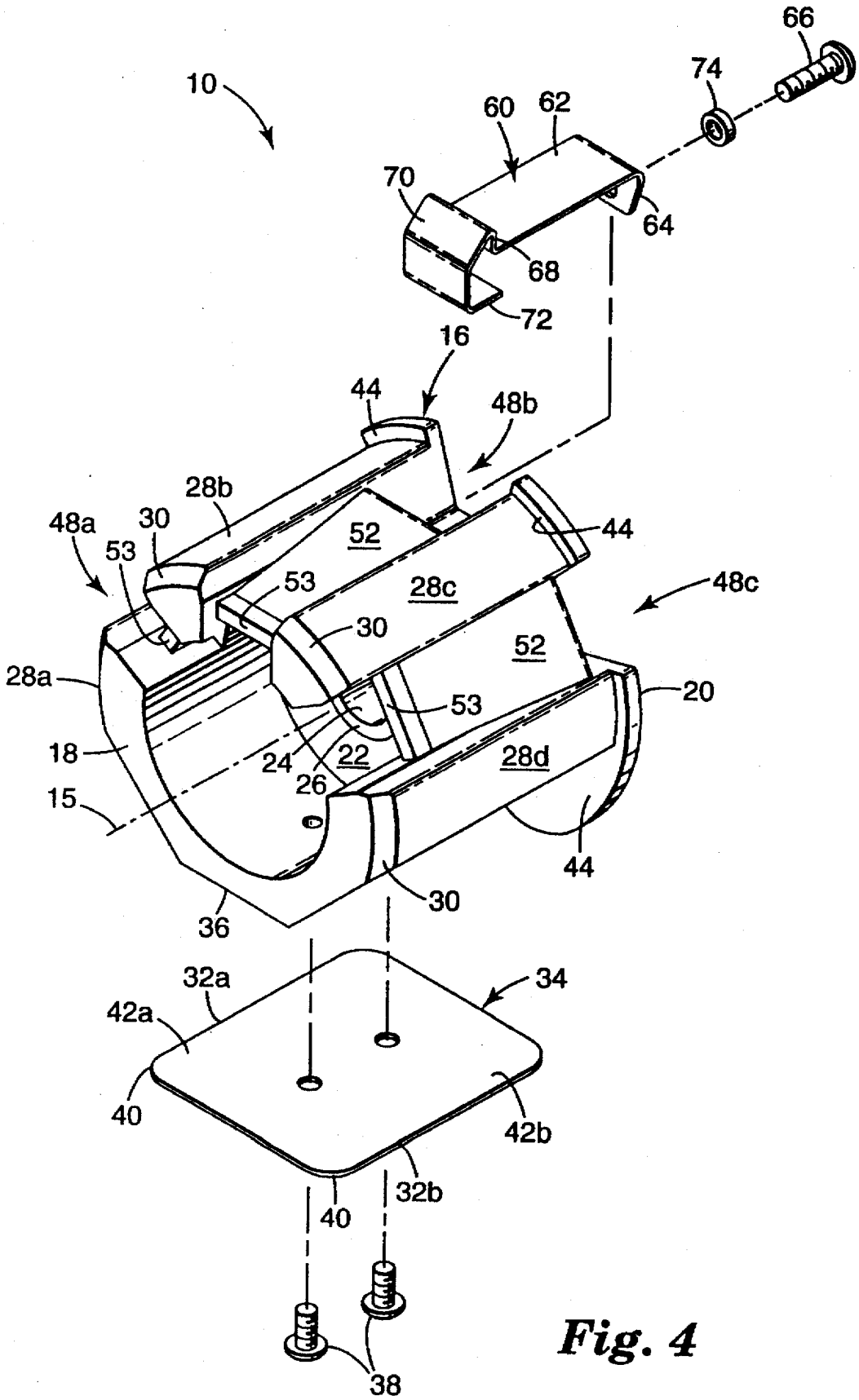
FIG. 4 is an exploded component view of the inventive hub.

A resilient arm or spring member 60 is mountable within at least one slot. The spring member 60 is preferably formed from spring steel, and extends axially between the first and second ends of the hub body 16, within one of its slots in a cantilevered support fashion, as shown. As best seen in FIGS. 4, 5 and 6, the spring member 60 is a sheet bent to a desired configuration, which includes a longitudinal face 62 sized to span a slot between adjacent core engaging surfaces. A radial extension 64 extends radially inwardly from the longitudinal face 62 adjacent the second end 20 of the hub body 16. The extension 64 is aligned with mounting face 50 on the hub body 16 for securing the spring member 60 to the hub body 16 by suitable means, such as fastener 66.

The spring member 60 has an operation position (shown in solid in FIGS. 5 and 6) wherein a retainer surface 68 thereon projects radially beyond the circumference defined by the core support surfaces 28*a*, 28*b*, 28*c* and 28*d*. In such a position, the retainer surface 68 is aligned to engage a second side of a core 14 (with its first side engaged by the stop surface 44) to affirmatively secure that core and its roll onto the hub 10. The spring member 60 is also shown in this core engaging position in FIGS. 1 and 2. The retainer surface 68 is disposed at the other end of the longitudinal face 62 on the spring member 60, adjacent the first end 18 of the hub body 16. The spring member 60 further includes a ramped surface 70 opposed the retainer surface 68 to facilitate insertion of a core over the spring member 60.

As mentioned, the spring member 60 is formed from resilient material, and as a core 14 is moved axially onto the hub 10, it engages the ramped surface 70, thereby urging the spring member 60 (and retainer surface 68) radially inwardly to its core insertion position (as shown in phantom in FIG. 6) within its slot (e.g., slot **48*b*) and out of the path of the advancing core 14 (also shown in phantom in FIG. 6). The spring member 60, affixed to the hub body 16 only adjacent the radial extension 64, thus cantilevers out of the way of the advancing core 14. Once the core 14 has been fully inserted with its first side engaging the radially extending surface 44, it no longer interferes with the retainer surface 68 of the spring member 60, and the resilient spring member 60 returns to its operative position (shown in solid in FIGS. 5 and 6) to retain the core 14 on the hub 10**.

Adjacent the first end 18 of the hub body 16, the spring member 60 is further bent to include a projection surface 72 extended around the end protrusion 53 and back towards the second end 20 of the hub body 16. The projection surface 72 is adapted to engage the stop face 54 on the end protrusion 53, thereby preventing over travel of the spring member 60 radially outwardly beyond its core engaging position, as illustrated in solid in FIG. 6.

The spring member 60 and operative retainer surface 68 thereon are thus received within one of the slots for use with the hub body 16 to engage and retain a core 14 thereon. The bias of the spring member 60 urges the retainer surface 68 into its operation position, but the spring member 60 is flexible enough to permit retraction of the retainer surface 68 into its slot for core insertion and removal. To remove an empty core, an operator merely depresses the spring member 60 by pushing the opposed ramp surface 70 radially inwardly and then pulling the core axially off of the hub body 16.

The spacing between the retainer surface 68 and stop surface 44 is preferably predefined to mate with a predefined core width. A core 14 is primarily held onto the hub 10 by frictional engagement therebetween, and the retainer surface 68 ensures that the core 14 will not become dislodged from the hub 10.

Within each slot, the spring member 60 is mountable in two axially disposed predetermined positions. FIG. 5 illustrates a first position, whereby the radial extension 64 abuts the radial mounting face 50. An alternative position which shortens the distance between the retainer surface 68 and stop surface 44 is illustrated in FIG. 6. A spacer 74 is mounted between the radial extension 64 and radial mounting face 50, thereby shortening the distance between retainer surface 68 and radially extending surface 44 by the width of the spacer 74. In a preferred embodiment, the spacer 74 is designed to change the axial spacing between the opposed surfaces 68 and 44 in any one slot from a common English unit core width to a common metric unit core width.

Figure 7:
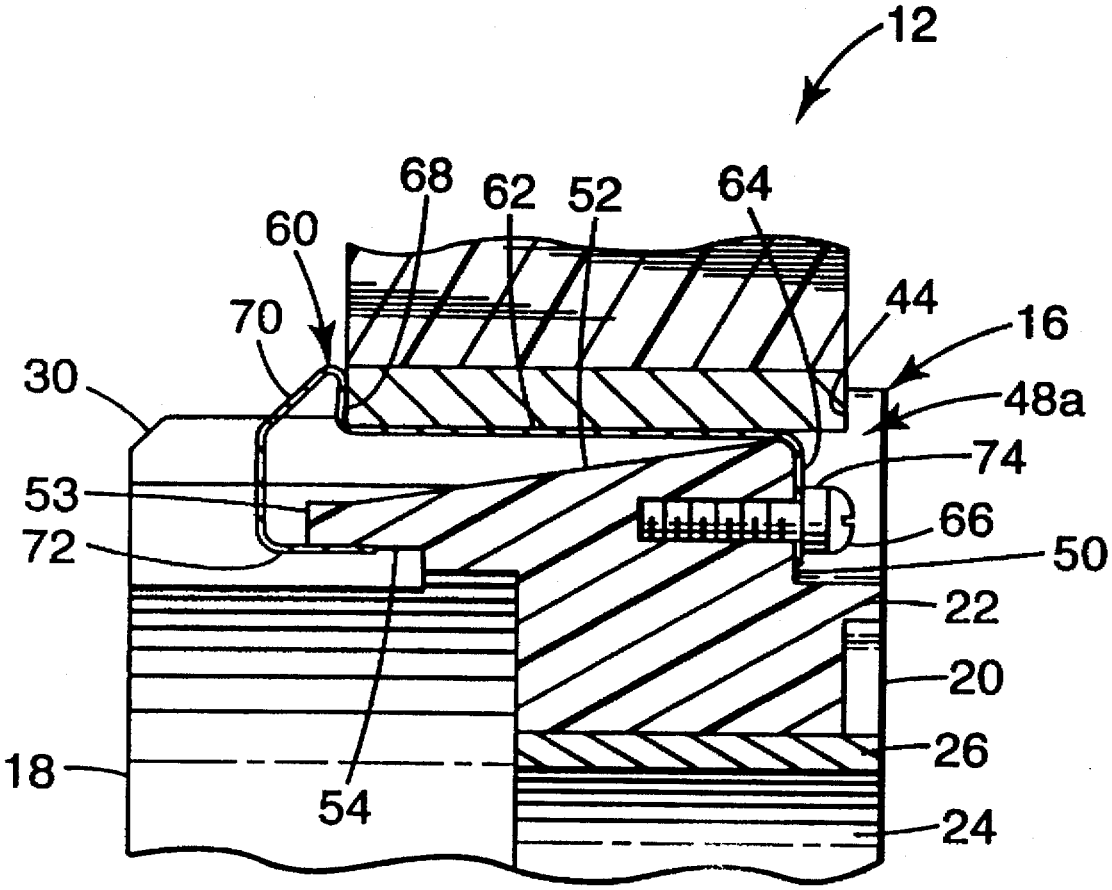
FIG. 7 is a partial sectional view of the inventive hub as taken along lines 7—7 in FIG. 2, with the addition of an arm in slot **48*a*** of the hub body and a smaller width core and roll retained thereby.

Preferably, a single spring member 60 is provided for each hub body 16, and can be selectively mounted in any one of the slots **48*a*, 48*b* or 48*c*. For instance, the spring member 60 is shown in phantom in FIG. 3 as it could be mounted in slots 48*a* and 48*c*. In FIGS. 5 and 6, the spring member 60 is shown mounted in slot 48*b*, designed to accommodate a 2 inch core width. In FIG. 7, the same spring member is shown mounted in slot 48*a***, designed to accommodate a 1.5 inch core width.

Within each slot, the spring member 60 has two axially disposed predetermined positions, depending on whether the Spacer 74 is used, as in FIG. 6. Thus, on a hub body 16 having three slots, six predefined positions for the retainer surface 68 (relative to the stop surface 44) are possible. The spring member 60 can be aligned in each of the three slots **48*a*, 48*b* or 48*c* to accept approximately 1.5 inch, 1.75 inch or 2 inch core widths (without using the spacer). Using a spacer of approximately 0.085 inches width, the axial spacing between retainer surface 68 and stop surface 44 can be changed to a metric configuration spacing of approximately 36 mm, 42 mm and 48 mm for each slot, respectively. In an alternative embodiment, the hub body 16 can be designed to accept approximately 2 inch, 2.5 inch and 3 inch core widths, and by using approximately a 0.125 inch wide spacer, the spring member 60 can be moved within the slots to accommodate approximately 48 mm, 60 mm and 72 mm core widths. Alternative widths, can of course be accommodated by varying the width of the spacer 74 or the configuration of the slots or spring member. Within each slot, the position of the retaining surface 68 relative to the radially extending surface 44 is determined by the axial alignments of face 50, protrusion 53 and faces 52 and 54**.

The roll supporting hub of the present invention can accommodate a plurality of predefined core widths in a single hub assembly. By moving the spring member 60 to accommodate a selected predefined core width, a core fully inserted onto the hub is thus affirmatively engaged and prevented from migrating off of the hub by the retainer surface 68 on the spring member 60. The core is also affirmatively coupled to the hub for rotation therewith in either direction by means of the edge surfaces **32*a* and 32*b*. Further, the spring member 60 can be moved between slots to accommodate various predetermined core widths, as necessary in the particular application. Once assembled, the hub provides an annular core support surface which serves to define a core transfer path over which a core must travel when being mounted or removed from the hub. The stop surface 44** defines the farthest extent of core insertion along the core transfer path, and although the core is primarily retained on the hub by friction between the core and core support surface, the retainer surface extends into the core transfer path to prevent inadvertent removal of the core from the hub. The roll supporting hub of this invention thus presents an extremely effective and economical means for supporting rolls of material such as adhesive tape on a tape dispensing machine or apparatus (or even on a hand-held tape dispenser).

Although the present invention has been described with reference to preferred embodiments, workers skilled in the art will recognize that changes may be made in form and detail without departing from the spirit and scope of the invention. For example, a cantilever support arm is illustrated as serving as the radially biased support for the retainer surface. It is understood that other structures and means for biasing the retainer surface will work as well, so long as they are readily adaptable for acceptance of different core widths on the same hub. The positions of the retainer surface in any particular slot can be variable (instead of simply at least two predefined positions) by modifications to the slot structure or to the bias and support for the retainer surface. Further, a hub having only one slot is contemplated, where that slot defines multiple positions for the retainer surface. Such multiple positioning in a slot can be achieved by a particular slot structure, the use of different sized spacers or by the use of different length supports for the retainer surface.

What is claimed is:

1. A hub for supporting a roll of material having a central core with first and second radial sides and having a plurality of possible predefined widths, the hub comprising:

a hub body having at least one core support surface extending circumferentially about a central rotation axis;

means for securing the central core of the roll to the core support surface for coupled coaxial rotation of the roll and hub body;

a stop surface on the hub body for engaging the first radial side of the core of the roll; and a radially retractable retainer surface spaced axially from the stop surface and selectively secured to the hub body to engage the second radial side of the core, the retainer surface having a plurality of possible predefined axially disposed positions relative to the stop surface, each of which corresponds to one of the predefined widths of the roll being supported by the hub.

2. The hub of claim 1 comprising a plurality of core support surfaces spaced circumferentially about the central axis.

3. The hub of claim 2 wherein the hub body has at least one axially extending surface slot spaced circumferentially about the central axis, and wherein each slot has means adapted to receive the retainer surface therein for placing the retainer surface in at least one of its predefined axially disposed positions.

4. The hub of claim 3 wherein at least two of the possible predefined positions for the retainer surface are defined in the slot.

5. The hub of claim 3 wherein the hub body has a plurality of axially extending surface slots spaced circumferentially about the central axis between respective core support surfaces, and wherein the means for placing the retainer surface is configured to locate the retainer surface in a different predefined position in each slot.

6. The hub of claim 1 wherein the securing means comprises:

at least a portion of the core support surface being defined as a core gripping edge surface.

7. The hub of claim 1 wherein the securing means comprises:

two core gripping edge surfaces which are opposed and aligned to prevent axial rotation of the core relative to the hub body.

8. The hub of claim 1 wherein the hub has a recess adapted to receive the retainer surface therein.

9. The hub of claim 8, and further comprising:

an arm adapted to be selectively received within the recess, the arm having first and second ends, and the arm bearing the retainer surface adjacent its first end and being secured to the hub body adjacent its second end.

10. The hub of claim 9 wherein the retainer surface is in an operation position when aligned to engage the second radial side of the core, wherein the arm is mounted relative to the hub body to permit radial retraction of the retainer surface within the recess to a core insertion position, and wherein the arm is biased in the operation position.

11. The hub of claim 9, and further comprising:

a stop on the arm for engaging a portion of the hub body to limit movement of the retainer surface past its operation position.

12. The hub of claim 1 wherein the stop surface has a radially disposed recess to facilitate access to the first radial side of the core by an operator.

13. The hub of claim 1 wherein the retainer surface has an opposed ramped face to facilitate axial insertion of a core onto the hub body and past the retainer surface.

14. The hub of claim 1 wherein the core support surface frictionally connects the core to the hub for coupled rotation.

* * * * *